US011590780B2

(12) United States Patent
Nagase et al.

(10) Patent No.: US 11,590,780 B2
(45) Date of Patent: Feb. 28, 2023

(54) PRINTING APPARATUS, PRINTING METHOD, AND STORAGE MEDIUM

(71) Applicant: CANON KABUSHIKI KAISHA, Tokyo (JP)

(72) Inventors: Tomoyuki Nagase, Yokohama (JP); Takeshi Koda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 16/831,853

(22) Filed: Mar. 27, 2020

(65) Prior Publication Data

US 2020/0307267 A1 Oct. 1, 2020

(30) Foreign Application Priority Data

Mar. 29, 2019 (JP) ..... JP2019-066213

(51) Int. Cl.

*B41J 11/66* (2006.01)
*B41J 11/00* (2006.01)
*B41J 11/02* (2006.01)

(52) U.S. Cl.

CPC ..... *B41J 11/663* (2013.01); *B41J 11/008* (2013.01); *B41J 11/0065* (2013.01); *B41J 11/02* (2013.01)

(58) Field of Classification Search

CPC ..... B41J 11/008; B41J 11/0065; B41J 11/663; B41J 11/68

See application file for complete search history.

(56) References Cited

U.S. PATENT DOCUMENTS

| | | | |
|---|---|---|---|
| 6,382,850 | B1 | 5/2002 | Freund et al. |
| 7,033,015 | B2 | 4/2006 | Takagi |
| 7,393,096 | B2 | 7/2008 | Takagi |
| 8,272,797 | B2 | 9/2012 | Morimoto et al. |
| 9,802,426 | B2 | 10/2017 | Onuma et al. |
| 10,543,698 | B2 | 1/2020 | Onuma et al. |

(Continued)

FOREIGN PATENT DOCUMENTS

| | | | |
|---|---|---|---|
| CN | 101497282 | A | 8/2009 |
| CN | 106183454 | A | 12/2016 |

(Continued)

OTHER PUBLICATIONS

Nakajima, MachineTranslationofJP-2003127429-A, 2003 (Year: 2003).*

(Continued)

*Primary Examiner* — Scott A Richmond
(74) *Attorney, Agent, or Firm* — Venable LLP

(57) ABSTRACT

A printing apparatus includes: a print head configured to eject ink based on print data; a conveyance unit configured to convey printing medium in a conveyance direction; a receiving portion configured to receive ink ejected beyond a first end of the printing medium in an intersecting direction, which intersects the conveyance direction; and a slitter configured to cut the printing medium in the conveyance direction at a predetermined position, wherein printing on one side of the printing medium in the intersecting direction is performed from the first end through the receiving portion, and wherein printing on the other side of the printing medium in the intersecting direction is performed beyond the predetermined position toward a second end side, which is on an opposite side of the first end.

25 Claims, 15 Drawing Sheets

(56) References Cited

U.S. PATENT DOCUMENTS

| | | | | |
|---|---|---|---|---|
| 2005/0024464 | A1 | 2/2005 | Takagi | |
| 2006/0139432 | A1 | 6/2006 | Takagi | |
| 2008/0302225 | A1* | 12/2008 | Endresen | B26D 1/025 83/486 |
| 2009/0128595 | A1 | 5/2009 | Komamiya et al. | |
| 2009/0196672 | A1 | 8/2009 | Morimoto et al. | |
| 2010/0129130 | A1* | 5/2010 | Ward | B65H 35/02 400/621 |
| 2010/0258017 | A1* | 10/2010 | Kersey | B26D 1/245 101/227 |
| 2011/0314981 | A1 | 12/2011 | Furuta | |
| 2016/0347091 | A1 | 12/2016 | Onuma et al. | |
| 2018/0015741 | A1 | 1/2018 | Onuma et al. | |

FOREIGN PATENT DOCUMENTS

| | | | | | |
|---|---|---|---|---|---|
| JP | H02-048972 | A | | 2/1990 | |
| JP | 2001-347690 | A | | 12/2001 | |
| JP | 2003-127429 | A | | 5/2003 | |
| JP | 2003127429 | A | * | 5/2003 | B41J 2/16526 |
| JP | 2005-053020 | A | | 3/2005 | |
| JP | 2017-013438 | A | | 1/2017 | |
| JP | 2019-010821 | A | | 1/2019 | |

OTHER PUBLICATIONS

Nov. 24, 2021 Chinese Official Action in Chinese Patent Appln. No. 202010226986.X.

Aug. 24, 2020 European Search Report in European Patent Appln. No. 20166298.8.

Dec. 20, 2022 Japanese Official Action in Japanese Patent Appln. No. 2019-066213.

* cited by examiner

PRINTING APPARATUS, PRINTING METHOD, AND STORAGE MEDIUM

BACKGROUND OF THE INVENTION

Field of the Invention

The present invention relates to a printing apparatus, a printing method, and a storage medium.

Description of the Related Art

In a printing apparatus such as an inkjet printing apparatus, borderless printing for printing an image up to the left and right ends of a printing medium is performed. In borderless printing, an image is printed up to the outside of the width of a printing medium. For processing ink that is ejected outside the width of the printing medium, an ink processing port is provided in advance. Therefore, in a printing apparatus including an ink processing port, borderless printing can be implemented only to a printing medium having a predetermined size that corresponds to the ink processing port.

Japanese Patent Laid-Open No. 2017-13438 (hereinafter referred to as Document 1) discloses a printed product discharge device provided with a slitter for cutting a long printing medium in parallel to the conveyance direction of the printing medium. The slitter disclosed in Document 1 is a pair of left and right slitters that are movable in the width direction of the printing medium, respectively, so as to be capable of cutting both the left and right ends of the printing medium. Therefore, by printing an image up to the outside of the width of a printing medium as desired and cutting the printing medium into a width as desired by use of the slitter, borderless printing can be implemented regardless of the size of the printing medium.

However, in the technology of Document 1, there is a possibility that the load for cutting increases because the left and right ends of a printing medium are cut by the pair of left and right slitters.

SUMMARY OF THE INVENTION

The printing apparatus according to an embodiment of the present invention includes: a print head configured to eject ink based on print data; a conveyance unit configured to convey printing medium in a conveyance direction; a receiving portion configured to receive ink ejected beyond a first end of the printing medium in an intersecting direction, which intersects the conveyance direction; and a slitter configured to cut the printing medium in the conveyance direction at a predetermined position, wherein printing on one side of the printing medium in the intersecting direction is performed from the first end through the receiving portion, and wherein printing on the other side of the printing medium in the intersecting direction is performed beyond the predetermined position toward a second end side, which is on an opposite side of the first end.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

First Embodiment

Figure 1:
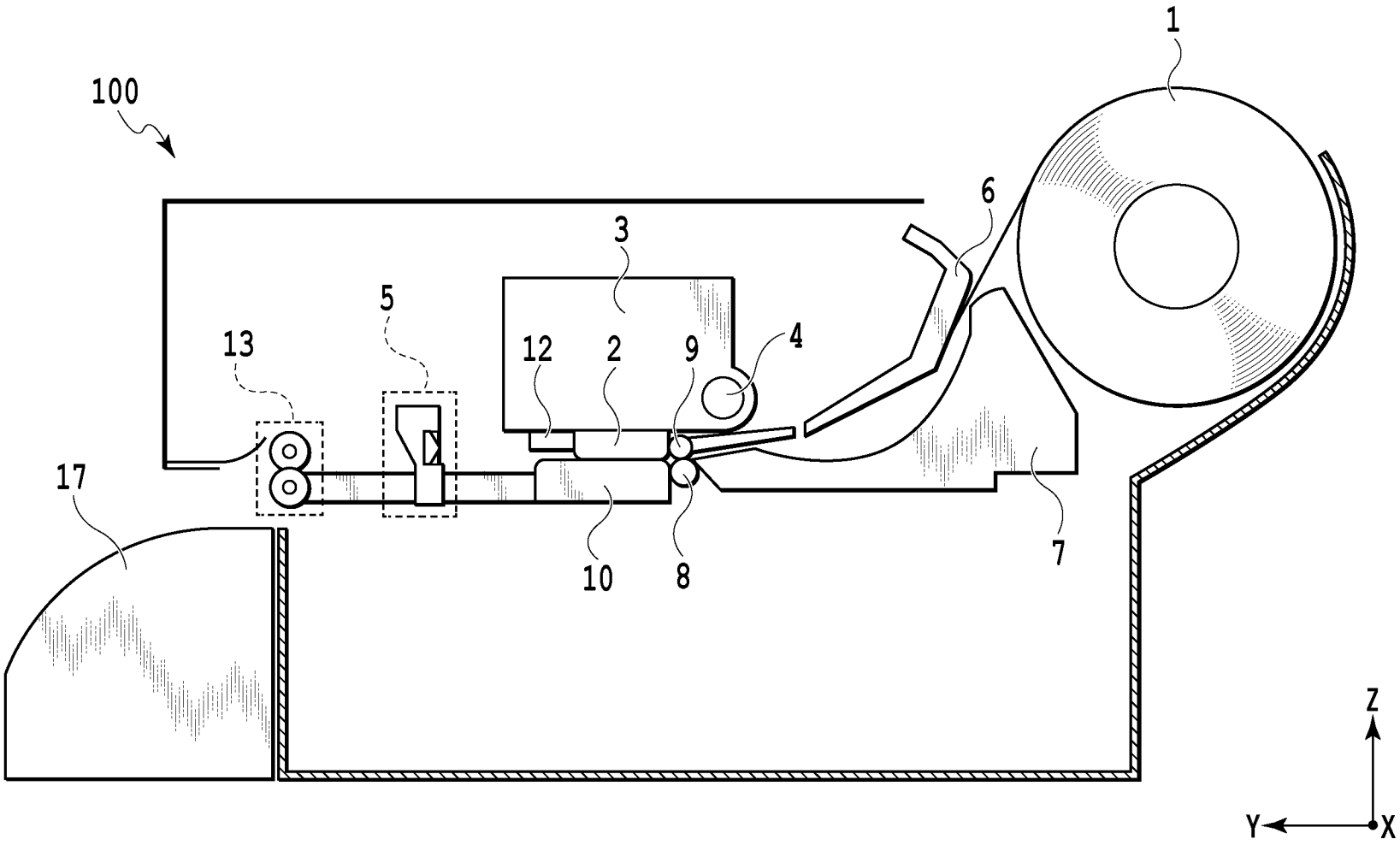
FIG. 1 is a cross-sectional view illustrating an example of a printing apparatus.

FIG. 1 is a cross-sectional view illustrating an example of an inkjet printing apparatus according to the present embodiment. The inkjet printing apparatus 100 (hereinafter may be referred to as the printing apparatus 100) performs printing on a printing medium that has a shape of a long sheet. In the present embodiment, the printing medium is a roll sheet 1. The roll sheet 1 held in the inkjet printing apparatus 100 is conveyed in the conveyance direction (Y direction) through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 that has been conveyed to the image printing unit, so that an image is printed.

The carriage 3 is supported so as to be able to perform a sliding motion along the guide shaft 4 and a guide rail (not illustrated in the drawing), which are disposed in parallel to each other in the inkjet printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the width direction (X direction) of the roll sheet 1 can also be detected by the reciprocating operation of the carriage 3. Instead of the above-described serial system, the printing system may be a full line system in which an image is printed while a roll sheet 1 is continuously conveyed, by use of a long print head that extends in the direction intersecting the conveyance direction of the roll sheet 1.

On the downstream relative to the carriage 3 in the conveyance direction of the roll sheet 1, there is provided the cutter 5 for cutting the roll sheet 1 in the intersecting direction (X direction), which intersects the conveyance direction, and, on the further downstream, there is provided the slitter 13 for cutting the roll sheet 1 in the conveyance direction. On the downstream relative to the slitter 13, there is provided the discharging guide 17 for discharging the roll sheet 1 that has been cut.

The cutter 5 includes a cutter unit 300 (see FIG. 2) as a cutting mechanism for cutting the roll sheet 1 and a unit for moving the cutter unit 300 along the X direction. Furthermore, the slitter 13 includes a slitter unit 303 (see FIG. 2) as a cutting mechanism for cutting the roll sheet 1 and a unit for moving the slitter unit 303 along the X direction.

Figure 2:
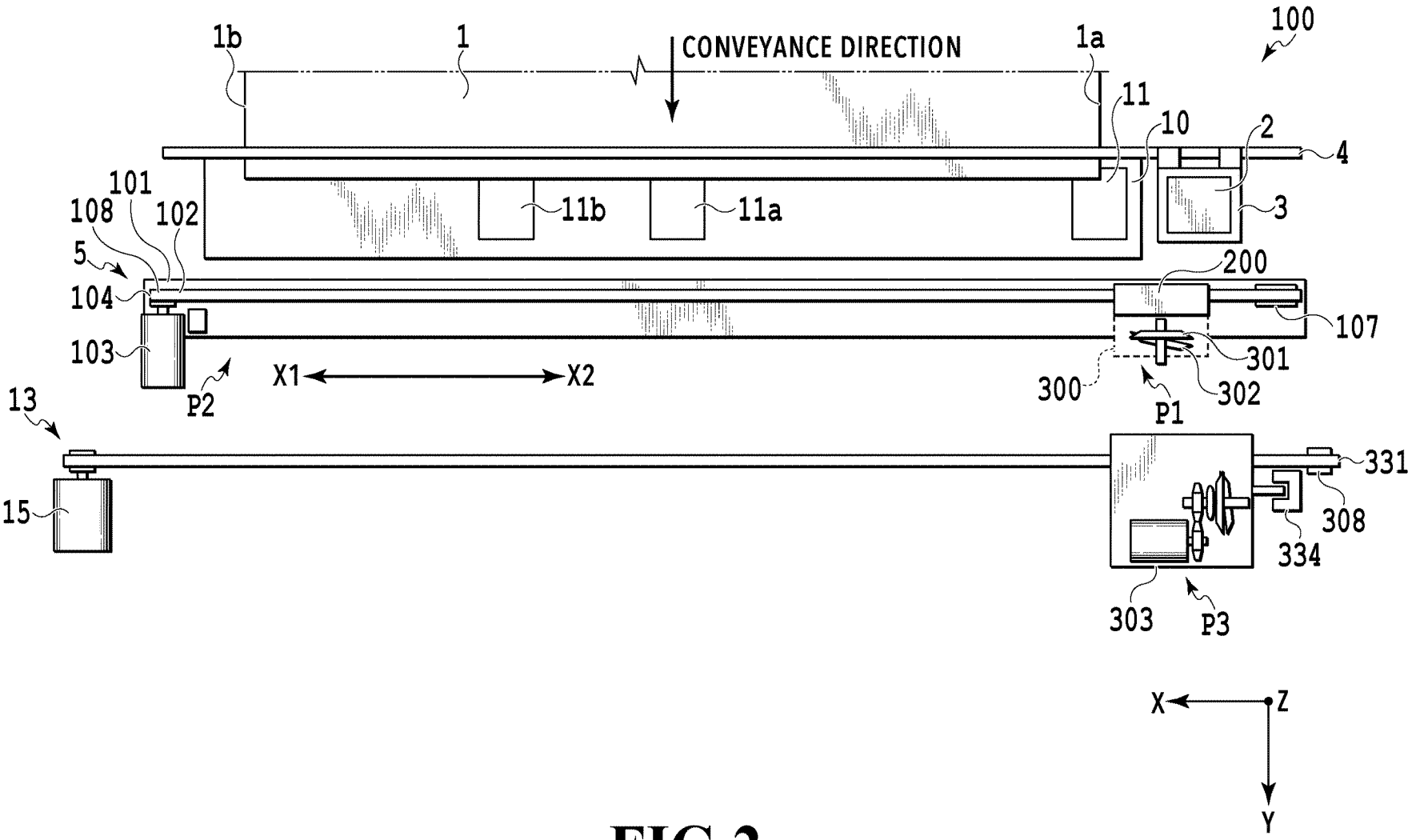
FIG. 2 is a top view of the printing apparatus.

FIG. 2 is a top view for explaining the platen 10, the cutter 5 and the slitter 13. At one end of the platen 10, an ink processing port 11 (ink receiving portion) is provided. In a case where printing is performed by scanning of the carriage 3, it is possible to perform borderless printing at one end of the roll sheet 1 by ejecting ink across the first end 1*a*, which is one end portion in the width direction (X direction which intersects the conveyance direction) of the roll sheet 1, so that the ink is ejected up to the ink processing port 11.

The platen 10 is provided with ink processing ports 11*a* and 11*b* in addition to the ink processing port 11. In a case where the second end 1*b*, which is on the opposite side of the first end 1*a* of the roll sheet 1 in the X direction, and the ink processing ports 11*a* and 11*b* overlap with each other, it is possible to perform borderless printing by use of the ink processing ports at both ends in the X direction. In the configuration of the present embodiment, the first end 1*a* side of a roll sheet is regarded as the reference, regardless of the width of the roll sheet, so that the roll sheet 1 is set such that the position of the second end 1*b* side changes according to the roll sheet width. Therefore, since the first end 1*a* of the roll sheet is always set at the position corresponding to the ink processing port 11, borderless printing can be performed on the first end 1*a* regardless of the roll sheet width.

On the other hand, the second end 1*b* side of the roll sheet may not match the positions of the ink processing ports 11*a* and 11*b*, depending on the size of the roll sheet, and, therefore, it may not be possible to perform borderless printing by use of the ink processing ports 11*a* and 11*b*. If printing is performed beyond the width of the roll sheet 1 up to a position where the ink processing ports 11*a* and 11*b* are not present, ink would adhere to the platen 10. Thereafter, if the roll sheet 1 is conveyed on the platen 10 to which the ink has adhered, the roll sheet 1 is soiled with the ink. Thus, in the present embodiment, in a case where borderless printing cannot be performed by use of the ink processing ports only, borderless printing is implemented by use of the later-described slitter 13.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter 5 performs cutting from the first end 1*a* of the roll sheet 1 to the second end 1*b* of the roll sheet 1. The first end 1*a* of the roll sheet 1 is an end portion on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. The slitter unit 303 is movable to a given position in the X1 and X2 directions and is capable of cutting the roll sheet 1 in a direction parallel to the conveyance direction (+Y direction).

Figure 3:
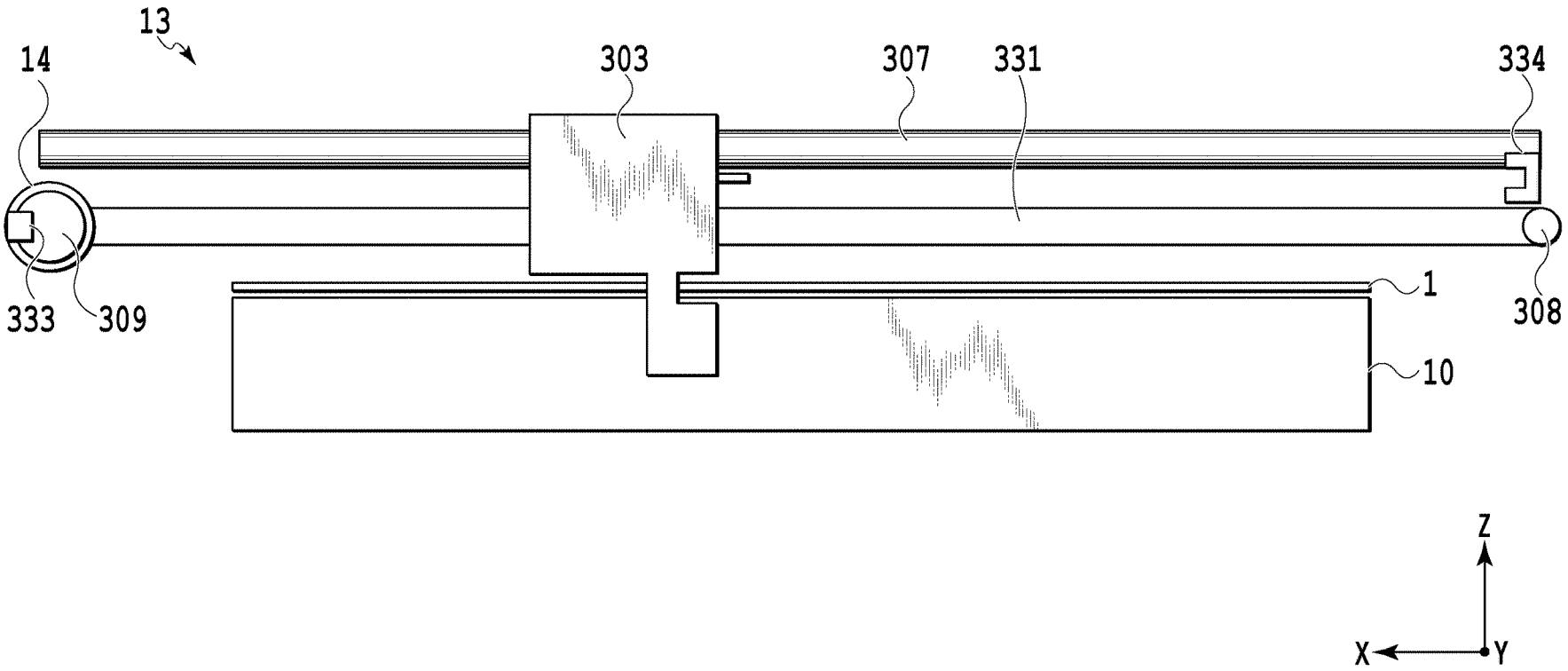
FIG. 3 is a schematic view illustrating a configuration in the vicinity of a slitter.
Figure 4A:
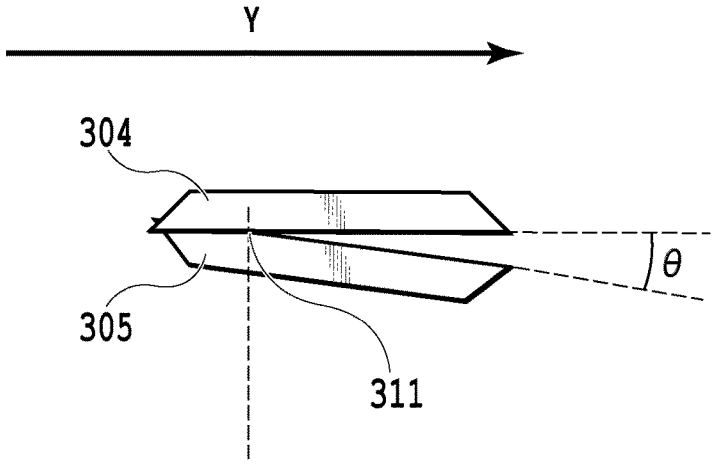
FIGS. 4A and 4B are diagrams for explaining movable blades of the slitter.
Figure 4B:
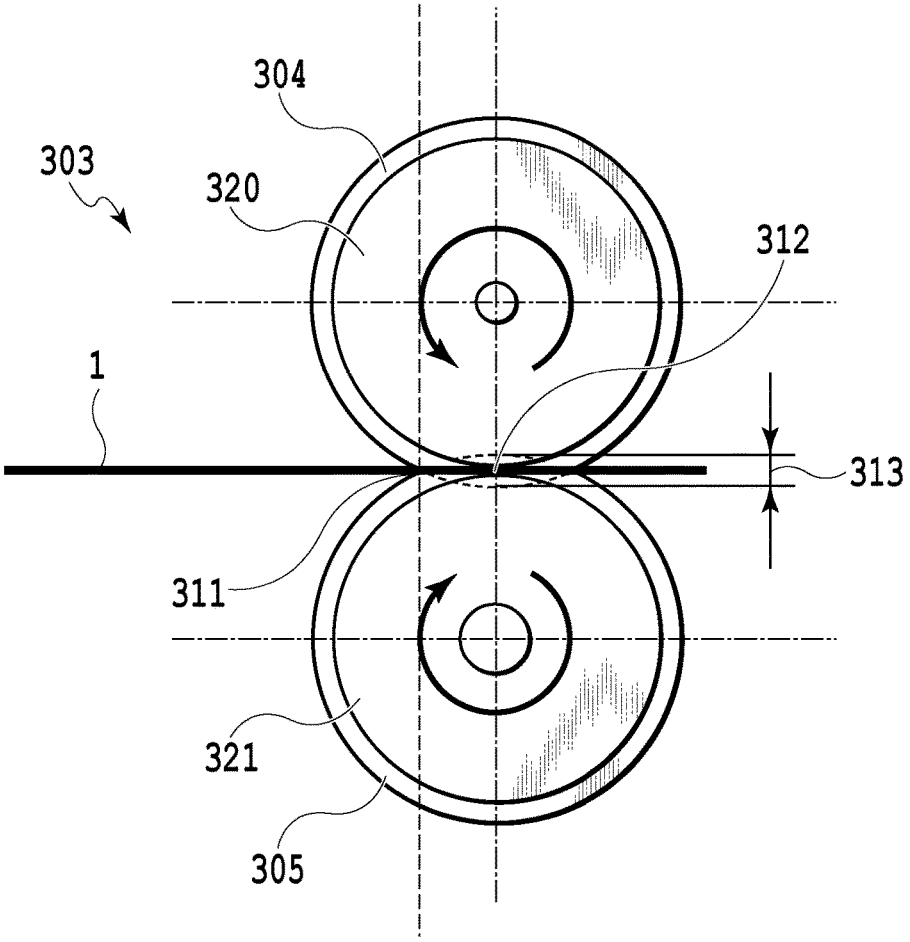
Figure 5:
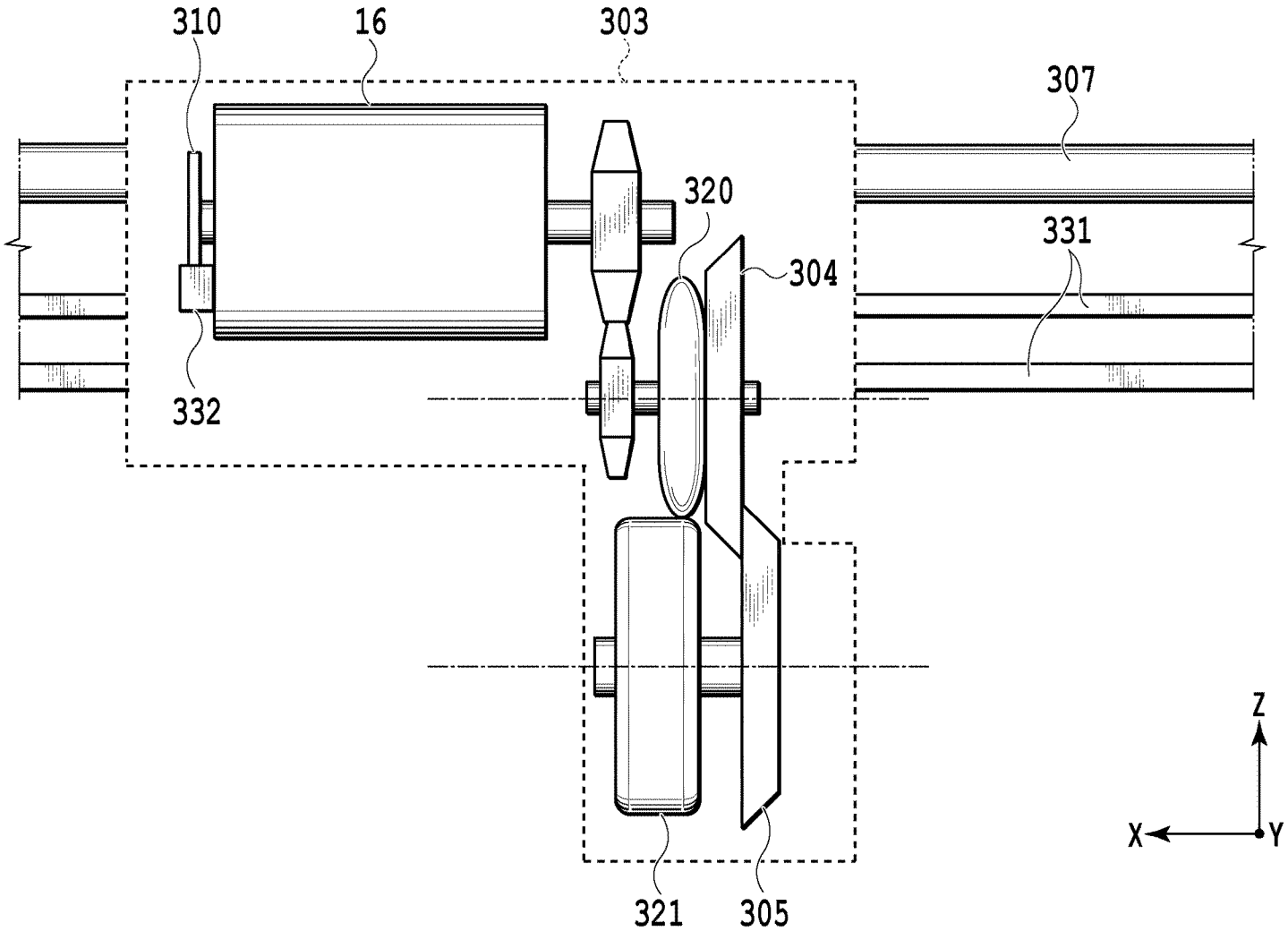
FIG. 5 is an enlarged view of a configuration in the vicinity of the slitter.

FIG. 3, FIGS. 4A and 4B, and FIG. 5 are diagrams for explaining details of the slitter 13. FIG. 3 is a schematic view illustrating a configuration in the vicinity of the slitter 13. FIGS. 4A and 4B are diagrams for explaining the movable blades of the slitter unit 303. FIG. 4A is a schematic top view of the slitter unit 303, and FIG. 4B is a schematic side view of the slitter unit 303. FIG. 5 is an enlarged view of a configuration in the vicinity of the slitter unit 303.

Hereinafter, an explanation is given of details of the slitter 13 with reference to the drawings.

As illustrated in FIG. 3, the slitter 13, which includes the slitter unit 303, is provided with the slitter guide rail 307, which supports the slitter unit 303 and is capable of guiding the slitter unit 303 in the X direction, in addition to the slitter unit 303. Furthermore, the slitter moving motor 14 for applying driving force for moving the slitter 13 in the X direction, the slitter tension pulley 308, and the slitter belt 331 are provided.

The driving force is transmitted from the slitter moving motor 14 via the slitter belt 331 to the slitter unit 303, and the slitter unit 303 is configured to be movable in the X direction along the slitter guide rail 307.

As illustrated in FIGS. 4A and 4B, the slitter unit 303 includes the slitter upper movable blade 304 and the slitter lower movable blade 305. The slitter upper movable blade 304 and the slitter lower movable blade 305 are disposed so as to have a round blades overlap amount 313 in the vertical direction and have a predetermined amount of angle (intersect angle) θ relative to the conveyance direction Y, which is the cutting direction. The roll sheet 1 is cut at the contact point 311 of the slitter upper movable blade 304 and the slitter lower movable blade 305. The slitter upper movable blade 304 is connected to the slitter driving motor 16 via a gear.

In a case where the slitter upper movable blade 304 is rotated by the driving force of the slitter driving motor 16, the slitter upper conveyance roller 320, which is connected coaxially with the slitter upper movable blade 304, is rotated as well. The outer diameter of the slitter upper conveyance roller 320 is in contact with the outer diameter of the slitter lower conveyance roller 321, which is connected coaxially with the slitter lower movable blade 305, at the roller nip point 312. Thus, by driving with friction transmission, while the roll sheet 1 is conveyed by the slitter upper conveyance roller 320 and the slitter lower conveyance roller 321, the upper and lower blades rotate together to cut the roll sheet 1 in the conveyance direction. Since the slitter driving motor 16 is provided with the slitter driving encoder 310, it is possible to control the slitter driving motor 16 with a predetermined rotation speed and a predetermined rotation amount. The slitter driving motor 16 is controlled to drive at a driving amount (specifically, a rotation speed and a rotation amount) that is synchronized with and corresponding to the conveyance amount by the conveyance roller 8.

As illustrated in FIG. 3, the slitter moving motor 14 is provided with the slitter moving encoder 309 and the encoder sensor 333. At the stand-by position P3 of the slitter unit 303, there is the slitter stand-by sensor 334. The movement position of the slitter unit 303 in the X direction can be controlled by pulse counting by use of the slitter moving encoder 309 and the encoder sensor 333 from a starting point based on detection of the slitter unit 303 by the slitter stand-by sensor 334. Furthermore, as illustrated in FIG. 5, the slitter driving motor 16 is provided with the slitter driving encoder 310 and the encoder sensor 332. The rotation amount of the slitter driving motor 16 can be controlled by pulse counting by use of the slitter driving encoder 310 and the encoder sensor 332.

As illustrated in FIG. 2, before image printing is performed on the roll sheet 1, the slitter unit 303 stands by at the stand-by position P3, which is outside (in the X direction) the area where the roll sheet 1 is conveyed. In a case of cutting the roll sheet 1, the slitter unit 303 moves from the stand-by position P3 in the X direction before the roll sheet 1 is conveyed up to the position of the slitter unit 303, so as to cut the conveyed roll sheet 1 in the conveyance direction. Here, the slitter 13 moves the slitter unit 303 in the X direction in accordance with the cutting position of the image to be printed. After cutting the roll sheet 1, the roll sheet 1 is cut by the cutter 5 at a given Y-direction position and discharged. In a case where the roll sheet 1 disappears from the scanning area of the slitter unit 303, the slitter unit 303 returns to the stand-by position P3 again along the slitter guide rail 307 and stands by for the next cutting operation.

By driving the cutter 5 and the slitter 13 in accordance with conveyance of the roll sheet 1 in the above-described manner, it is possible to cut the roll sheet 1 in the X direction and the Y direction as desired.

Next, an explanation is given of general operation of cutting by the slitter 13. First, the slitter unit 303 is moved to a cutting position, and the roll sheet 1 is conveyed by the conveyance roller 8 while the conveyance motor 51 and the slitter driving motor 16 are driven at the same speed. In a case where the leading edge of the roll sheet 1 reaches the contact point 311 of the slitter 13, the roll sheet 1 is cut by the slitter upper movable blade 304 and the slitter lower movable blade 305. Furthermore, the roll sheet 1 is nipped and conveyed by the slitter upper conveyance roller 320 and the slitter lower conveyance roller 321 while being cut, so as to be discharged through the discharging guide 17.

Additionally, cutting by the slitter 13 can be performed together with image printing. The slitter unit 303 moves from the stand-by position to a predetermined cutting position in the X1 and X2 directions according to the setting by the user. Then, the roll sheet 1 is conveyed by the conveyance roller 8 while the conveyance motor 51 and the slitter driving motor 16 are driven at the same speed. In the image printing unit, in response to forward or return scanning of one line by the carriage 3 for printing an image, the roll sheet 1 is conveyed by the conveyance roller 8 and the pinch roller 9 by a predetermined pitch. Then, the carriage 3 is moved again to perform image printing of the next line. In a case where printing proceeds and the leading edge of the roll sheet 1 reaches the contact point 311, the roll sheet 1 is cut by the slitter upper movable blade 304 and the slitter lower movable blade 305 that are rotating. Furthermore, the roll sheet 1 is nipped and conveyed by the slitter upper conveyance roller 320 and the slitter lower conveyance roller 321 while being cut. Then, the image printing ends and the cutting by the slitter unit 303 ends. Subsequently, the slitter unit 303 moves to the predetermined stand-by position. The roll sheet 1 is conveyed up to a position to be cut where the cutter 5 can cut the roll sheet 1, then the roll sheet 1 is cut by the cutter unit 300, so as to be discharged through the discharging guide 17.

The configuration of the slitter 13 described above is merely an example. That is, the slitter 13 may have any configuration as long as the slitter 13 is movable in the width direction of the roll sheet 1 and is capable of cutting the conveyed roll sheet 1 in the conveyance direction at a given position of the width direction. Furthermore, there may be a mode in which the slitter upper conveyance roller 320, the slitter lower conveyance roller 321, the slitter upper movable blade 304, and the slitter lower movable blade 305 are independently driven.

Figure 6:
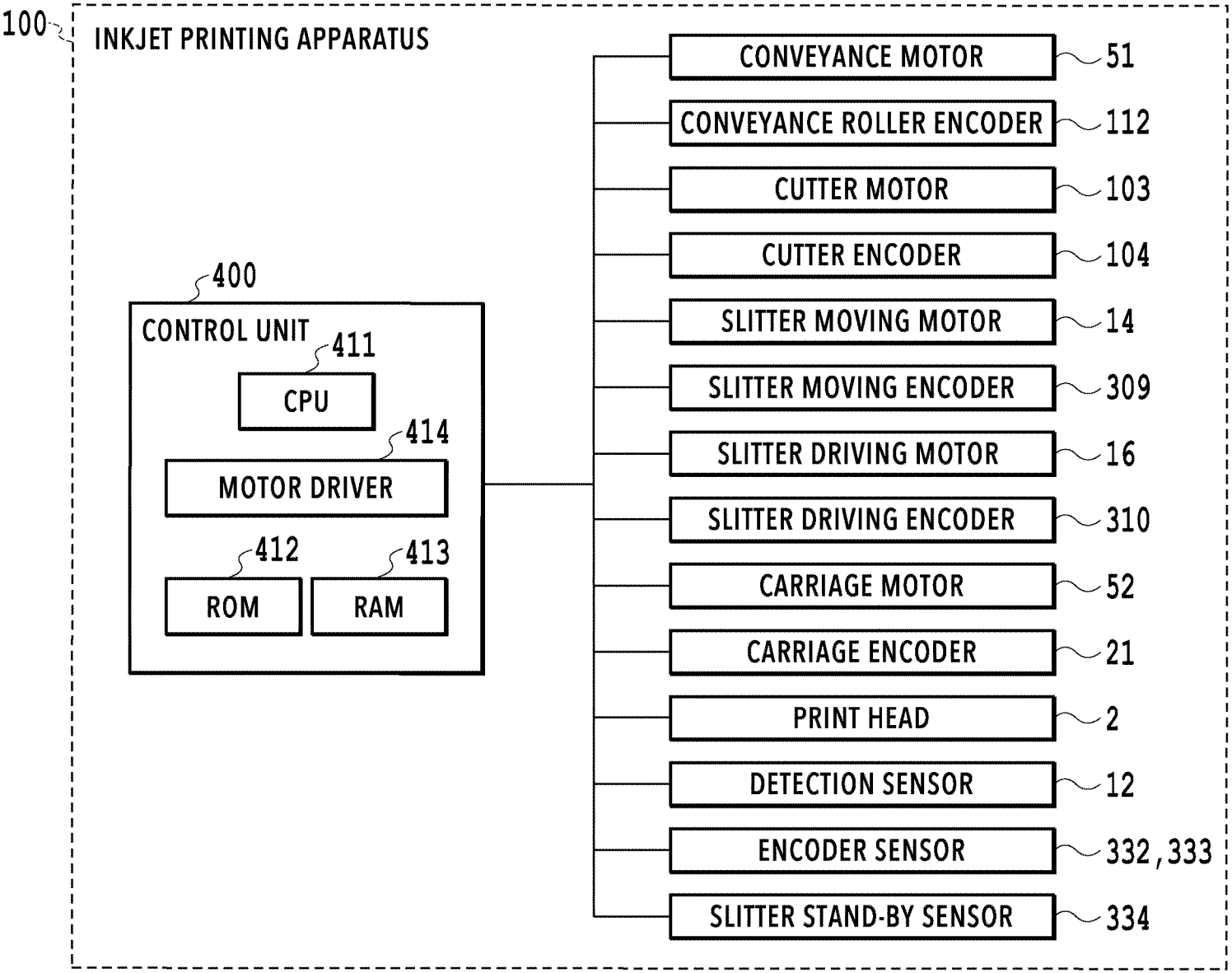
FIG. 6 is a schematic block diagram illustrating a control configuration of the printing apparatus.

FIG. 6 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 21, and a detection sensor 12. Further, the control unit 400 obtains signals from encoder sensors 332 and 333 and a slitter stand-by sensor 334. Moreover, the control unit 400 controls the various motors and the print head 2, based on the signals.

Figure 7:
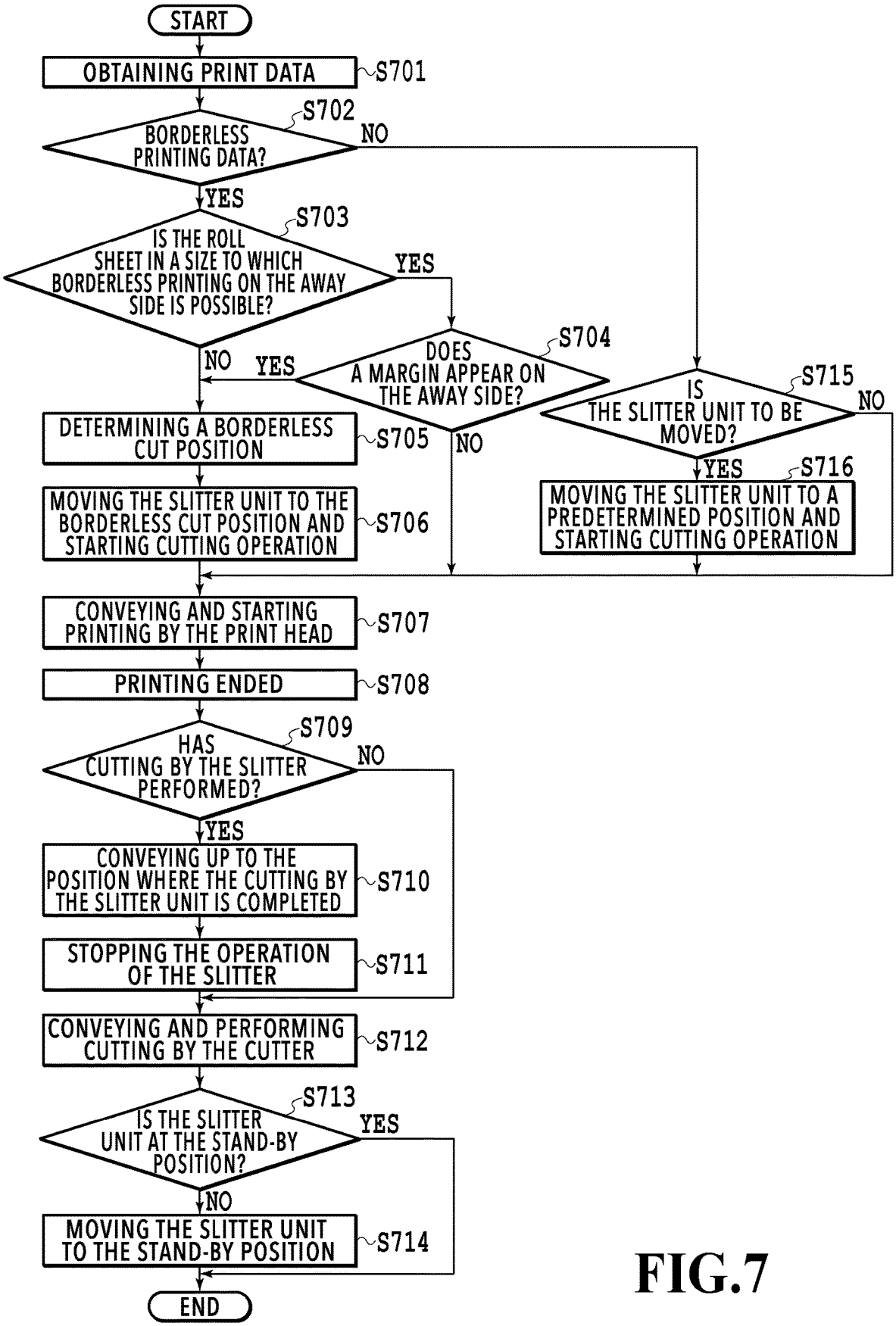
FIG. 7 is a diagram illustrating an example of a flowchart of performing borderless printing.

FIG. 7 is a diagram illustrating an example of a flowchart of performing borderless printing in the present embodiment. Moreover, FIGS. 8 through 13 are diagrams illustrating how an image is printed on the roll sheet 1 and how the roll sheet 1 is cut. Hereinafter, an explanation is given of specific operation and respective states with reference to the flowchart of FIG. 7 and the diagrams of FIGS. 8 through 13. The processing of FIG. 7 is performed by the CPU 411 of the printing apparatus 100 retrieving a program code stored in the ROM 412 into the RAM 413 and executing the program code. Alternatively, a part or all of the functions corresponding to the steps in FIG. 7 may be implemented by hardware such as an ASIC or an electronic circuit. The symbol "S" in the explanation of each process means that it is a step in the sequence. Hereinafter, for the sake of simplicity of the explanation, it is assumed that the control unit 400 of the printing apparatus 100 performs the various processes in accordance with the above-described processing.

The processing of FIG. 7 is processing from a stand-by state in which the power supply of the printing apparatus 100 is on.

In S701, the control unit 400 obtains print data. Print data is included in a print job which is transmitted from an external host apparatus (not illustrated in the drawings), for example. Alternatively, print data (print job) may be obtained from an external medium (not illustrated in the drawings), which is attached to the printing apparatus 100. It is also possible to obtain print data generated in response to an instruction that is input to the printing apparatus 100 via an operation panel (not illustrated in the drawings), or the like, by the user.

In S702, the control unit 400 determines whether the print data obtained in S701 includes an instruction for performing borderless printing. For example, it is assumed that print data is transmitted in a state where performing of borderless printing has been set on a print setting screen of a host apparatus (not illustrated in the drawings). In this case, the print data is transmitted in a state where an instruction for performing borderless printing is included in a predetermined information area. The control unit 400 determines whether to perform borderless printing with reference to the obtained print data. Alternatively, in a case where performing of borderless printing has been set via an operation panel (not illustrated in the drawings) of the printing apparatus 100, it is possible to determine that the print data obtained in S701 is print data for performing borderless printing. In a case where the print data is print data for performing borderless printing, the processing proceeds to S703. In a case where the print data is not print data for performing borderless printing, the processing proceeds to S715.

In S703, the control unit 400 determines whether it is possible to perform borderless printing of the left and right ends in the width direction (X direction) of the roll sheet 1 by use of the existing ink processing ports 11, 11*a*, and 11*b*. As explained above, in the present embodiment, the first end 1*a* (right end portion) on one side of the roll sheet 1 is the reference. Hereinafter, in the width direction (X direction) of the roll sheet 1, the end portion side corresponding to the first end 1*a* of the roll sheet 1 is referred to as the home side, and the other end portion side corresponding to the second end 1*b* is referred to as the away side. The ink processing port 11 corresponds to the home side as explained above. Therefore, by comparing the positions of the second end 1*b* (left end portion) on the other side of the roll sheet 1 and the ink processing ports 11*a* and 11*b* on the away side, whether it is possible to perform borderless printing of the left and right ends is determined. More specifically, whether the ink processing ports 11*a* and 11*b* are positioned on the away side of the second end 1*b* of the roll sheet 1 is determined. For example, for this determination, the size in the width direction of the roll sheet 1 corresponding to the positions of the ink processing ports 11*a* and 11*b* is stored in advance in the ROM 412, or the like, and whether the loaded roll sheet 1 has a size corresponding to the size is determined. The size of the loaded roll sheet 1 may be detected by a sensor, or the like, mounted on a sheet guide (not illustrated in the drawings). Alternatively, the size of the loaded roll sheet 1 can be detected based on an input via an operation panel (not illustrated in the drawings) of the printing apparatus 100, setting information from an external host apparatus, the detection sensor 12 mounted on the carriage 3, or the like.

In the present embodiment, the positions of the ink processing ports 11*a* and 11*b* disposed on the away side correspond to the standard size. Thus, whether it is possible to perform borderless printing by use of the existing ink processing ports 11, 11*a*, and 11*b* may be determined according to whether the size in the width direction of the roll sheet 1 loaded in the printing apparatus 100 is the standard size or not.

As a result of S703, if the roll sheet 1 is not in a size corresponding to the ink processing ports, the processing proceeds to S705, and, if the roll sheet 1 is in a size corresponding to the ink processing ports, the processing proceeds to S704. If printing is performed beyond the width of the roll sheet 1 up to a position where the ink processing ports 11*a* and 11*b* are not present, the ink adheres onto the platen 10. Thereafter, if the roll sheet 1 is conveyed on the platen 10 to which the ink has adhered, the roll sheet 1 is soiled with the ink. For this reason, in the present embodiment, printing beyond the width of the roll sheet 1 is not performed at positions where the ink processing ports 11*a* and 11*b* are not present.

In S704, the control unit 400 determines whether a margin appears at the second end 1*b* of the roll sheet 1, which is on the away side. The control unit 400 compares the size of the image corresponding to the print data of S701 with the size of the loaded roll sheet 1, so as to determine whether a margin appears. In a case where a margin appears, the margin area needs to be cut off so as to implement borderless printing. For example, it is assumed that the size of the loaded roll sheet 1 is A1 size, and the size of the image corresponding to the print data is A2 size. In this case, the image is printed only in half of the area in the width direction of the roll sheet 1 and the other half of the area is a margin area. In a case where an instruction for borderless printing is included, a process of cutting off such a remaining margin area so as to implement borderless printing is performed. For this reason, in S704, if a margin appears at the second end 1*b* of the roll sheet 1, which is positioned on the away side, the processing proceeds to S705, so that borderless printing is performed by cutting by the slitter 13. If no margin appears, the processing proceeds to S707.

As described above, by the determination in S704 and S705, whether or not cutting operation by use of the slitter 13 is performed in a case of performing borderless printing is determined.

In S705, the control unit 400 determines a borderless cut position. That is, if the size of the roll sheet 1 is not a size corresponding to the ink processing ports 11*a* and 11*b* in S703 or if a margin appears, borderless printing is implemented by cutting by the slitter 13. In S705, the control unit 400 determines a predetermined position corresponding to the size of the image corresponding to the print data as the position (the later-described cutting position X3 in FIG. 8) of the slitter unit 303. In S706, the control unit 400 moves the slitter unit 303 from the stand-by position P3 to the determined position. Further, the control unit 400 makes the slitter driving motor 16 drive, so as to rotate the slitter upper movable blade 304 and the slitter lower movable blade 305 of the slitter unit 303 that has reached the predetermined borderless printing position and thereby complete the cutting preparation.

Next, in S707, the control unit 400 conveys the roll sheet 1 onto the platen 10 and starts printing by the print head 2. That is, the control unit 400 performs printing on the roll sheet 1 based on the print data obtained in S701.

Figure 8:
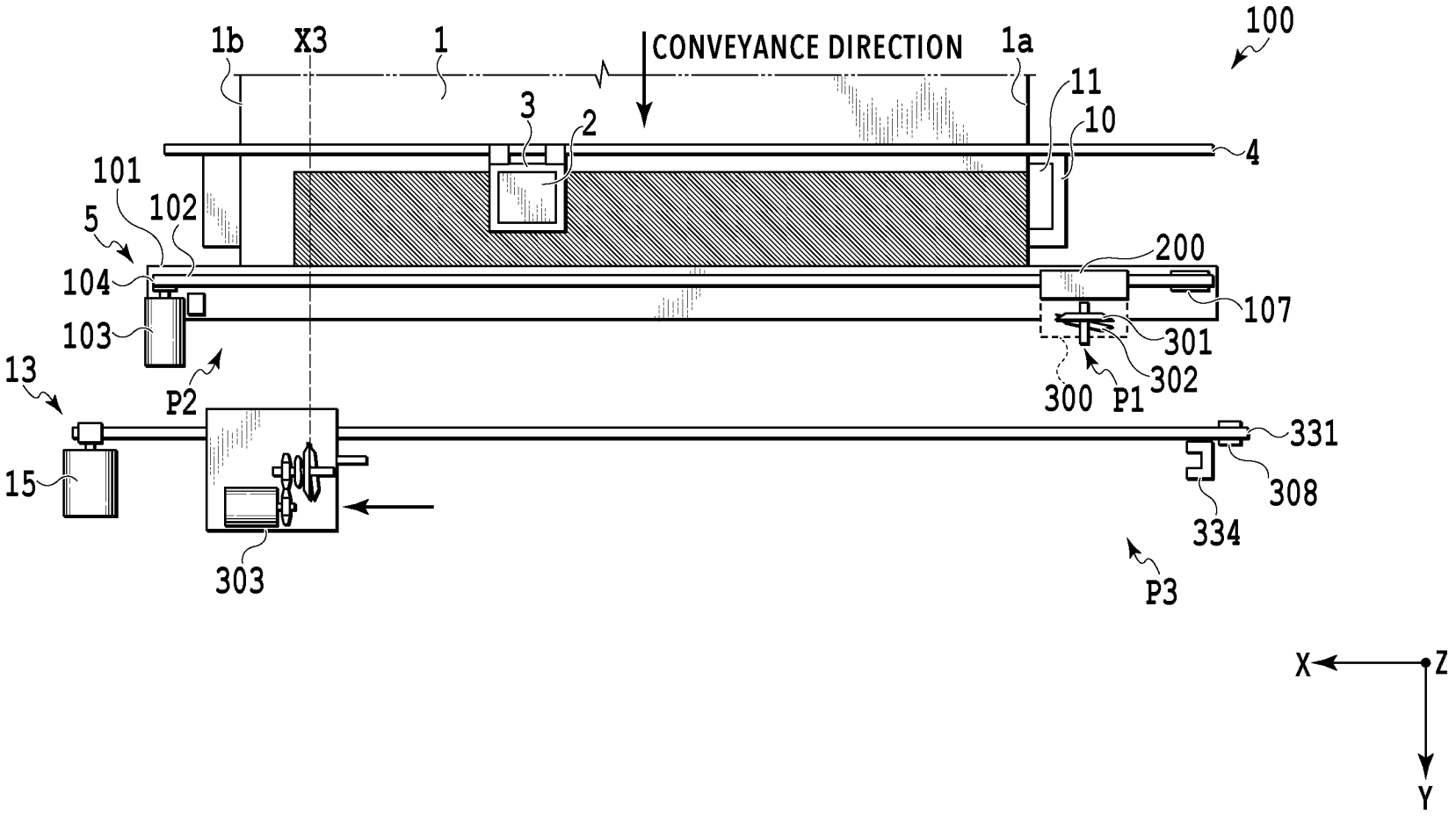
FIG. 8 is a diagram illustrating how an image is printed and a roll sheet is cut.

FIG. 8 is a diagram illustrating a state in which the slitter unit 303 has moved from the stand-by position P3 to the cutting position X3 determined in S705 and is being rotationally driven. Furthermore, in FIG. 8, printing operation in S707 is started. The gray part in FIG. 8 represents an area in which the image is printed. As illustrated in FIG. 8, on the home side, borderless printing is performed up to the ink processing port 11 beyond the first end 1*a* of the roll sheet 1. Furthermore, on the away side, printing is performed on the second end 1*b* side of the roll sheet 1 beyond the cutting position X3 of the roll sheet 1. That is, printing by the print head 2 is performed up to a position that is beyond the cutting position X3, which is to be cut by the slitter unit 303, in the X direction.

Since the roll sheet 1 is nipped and conveyed by the conveyance roller 8 and the pinch roller 9, the conveyance amount of the roll sheet 1 in the conveyance direction can be controlled in detail. Therefore, in a case of borderless printing, printing is performed by the print head 2 from the leading edge position of the roll sheet 1 in the conveyance direction. It is also possible that printing of the image is started with a predetermined length of the leading end portion of the roll sheet 1 as a margin, and, in a case where the rear end of the margin reaches the cutting position of the cutter 5 in the conveyance direction, the rear end of the margin is cut by the cutter 5, and then printing and conveying is continuously performed.

Figure 9:
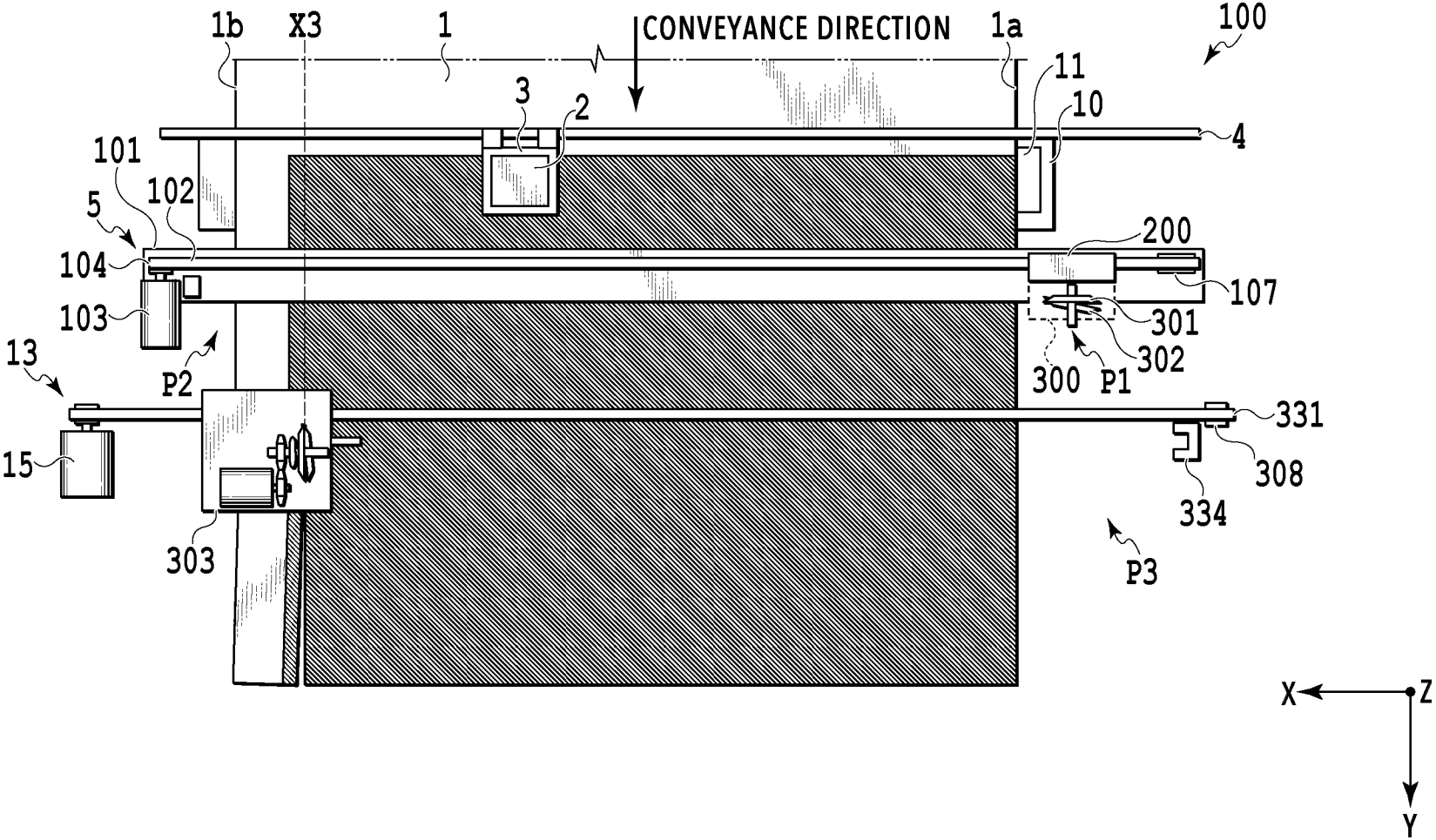
FIG. 9 is a diagram illustrating how an image is printed and a roll sheet is cut.

FIG. 9 is a diagram illustrating a state in which printing and conveying have progressed and cutting of the roll sheet 1 by the slitter unit 303 has begun. At the cutting position X3, the roll sheet 1 enters the slitter unit 303, and cutting of the roll sheet 1 has begun in parallel to the conveyance direction (that is, in the Y direction). Here, in the slitter unit 303, the slitter upper movable blade 304 and the slitter lower movable blade 305 are driven by the above-described slitter driving motor 16 to keep rotating, so as to cut the roll sheet 1 in accordance with conveyance of the roll sheet 1.

Printing ends in S708. In S709, the control unit 400 determines whether cutting by the slitter 13 has been performed on the roll sheet 1 on which printing ended in S708. If cutting by the slitter 13 has been performed, the processing proceeds to S710, and, otherwise, the processing proceeds to S712.

If cutting by the slitter 13 has been performed, the control unit 400 conveys the roll sheet 1 in S710 such that the roll sheet 1 is cut by the slitter unit 303 up to the position Y4 to be cut, which is defined by the print data. That is, even after printing ends, the roll sheet 1 is conveyed by a predetermined conveyance amount, so that the cutting of the roll sheet 1 by the slitter 13 is continued.

Figure 10:
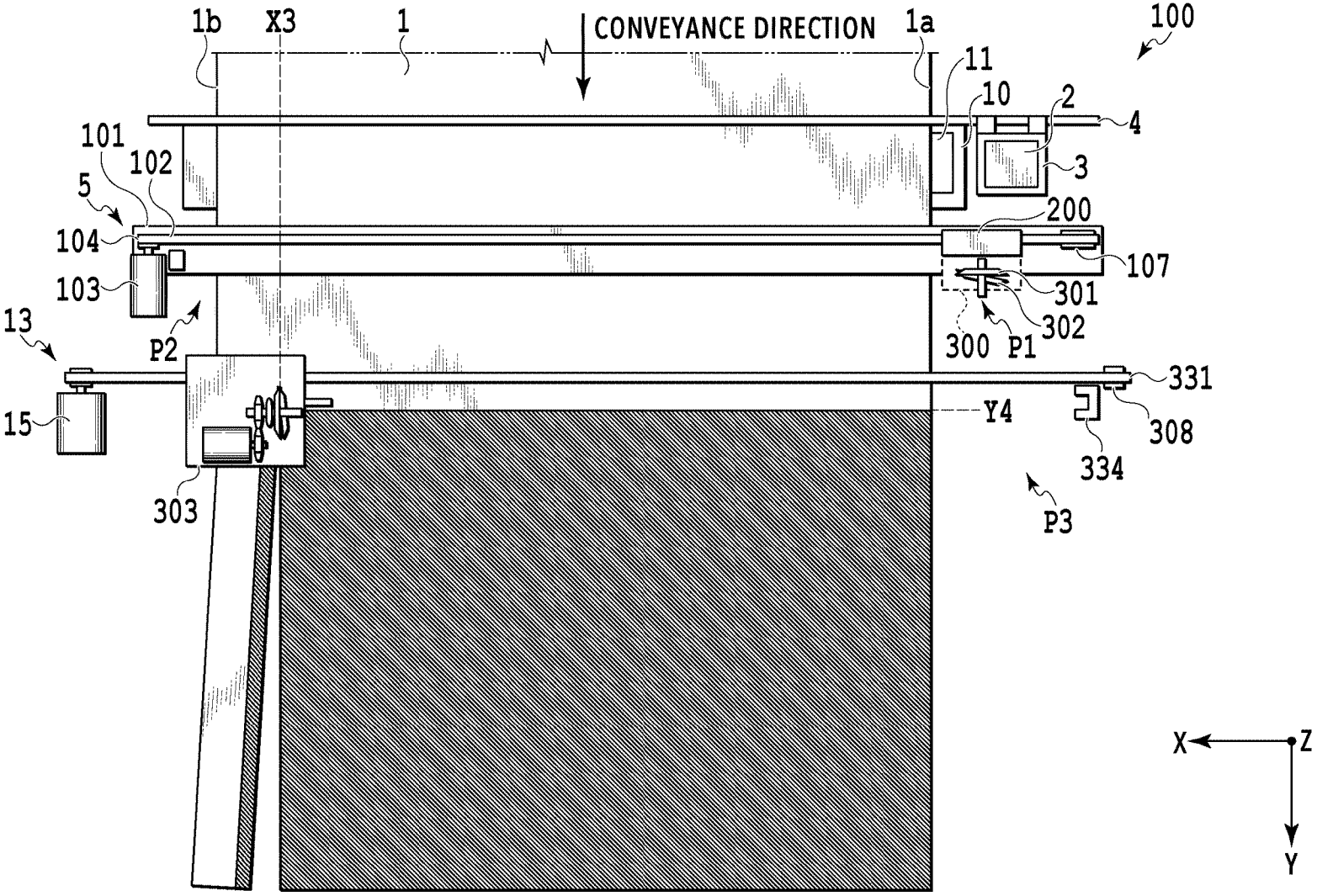
FIG. 10 is a diagram illustrating how an image is printed and a roll sheet is cut.

FIG. 10 is a diagram illustrating a state in which the roll sheet 1 is conveyed and cut even after the printing ends, so that the cutting of the roll sheet 1 by the slitter unit 303 is completed up to the position Y4 to be cut, where the printing of the image corresponding to the print data has ended. It is also possible that the slitter unit 303 cuts beyond the image corresponding to the print data by a predetermined length. That is, cutting by the slitter unit 303 may be further performed from the position Y4 to be cut, which is the rear end of the image, by a predetermined length.

In S711, the control unit 400 stops the operation of the slitter 13, in which cutting has been performed up to the position Y4 to be cut. That is, the control unit 400 stops the operation of the slitter driving motor 16.

Figure 11:
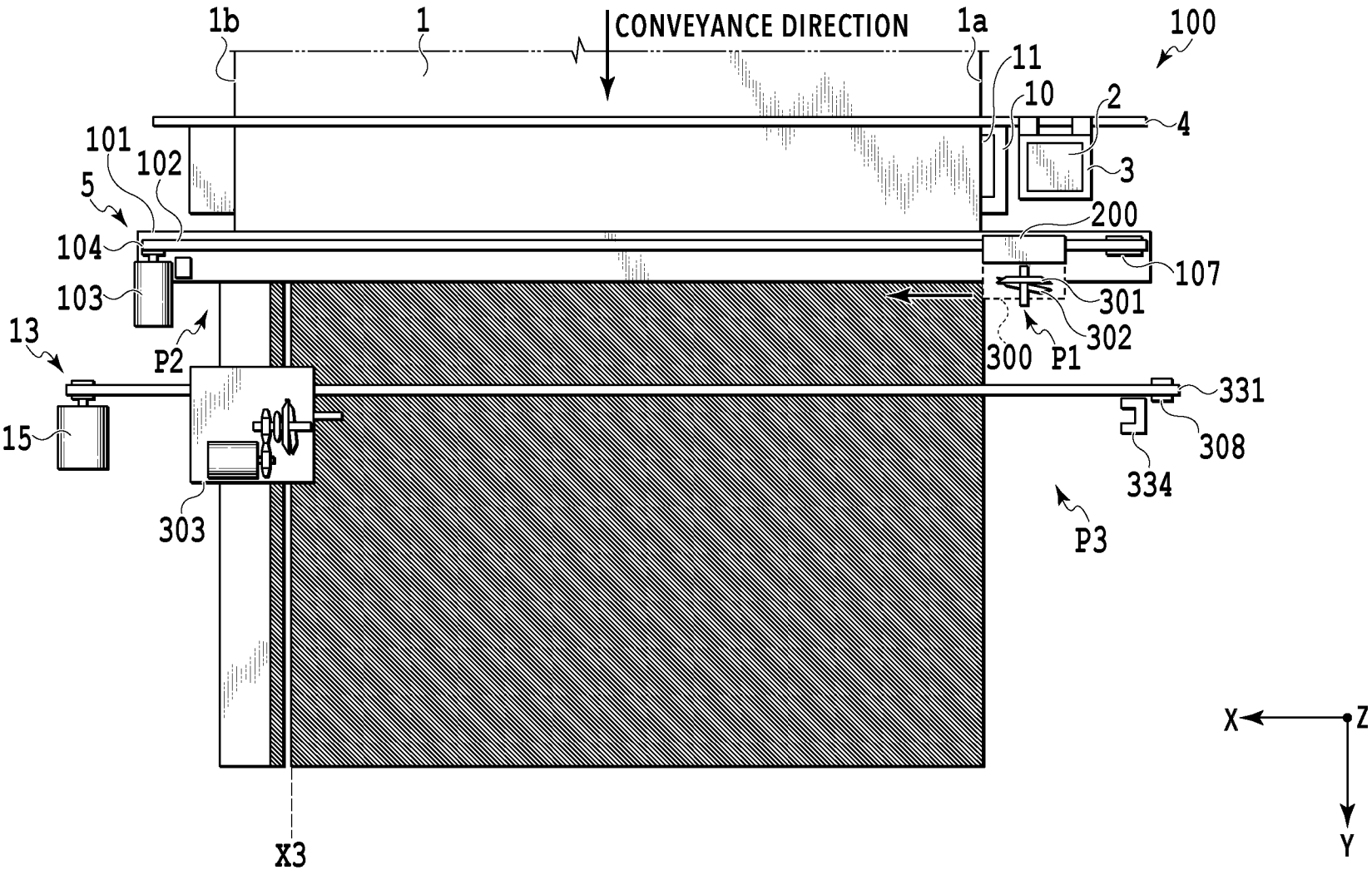
FIG. 11 is a diagram illustrating how an image is printed and a roll sheet is cut.

In S712, the control unit 400 conveys the roll sheet 1 to a position where the cutter 5 cuts the roll sheet 1 in the width direction (X direction). FIG. 11 is a diagram representing how the cutting by the cutter 5 in the X direction (direction intersecting the conveyance direction of the roll sheet 1) is performed after the cutting by the slitter 13 ends. The control unit 400 controls the cutter 5 to cut the roll sheet 1 after the roll sheet 1 is conveyed to the predetermined position. In the present embodiment, the cutter 5 is disposed on the upstream relative to the slitter 13 in the conveyance direction of the roll sheet 1. Therefore, by conveying the roll sheet 1 in the opposite direction of the conveyance direction, the roll sheet 1 is conveyed up to the predetermined position. That is, the roll sheet 1 is conveyed up to such a position where the position Y4 to be cut of the roll sheet 1 is at the position of the cutter 5 in the Y direction. In a case where the conveyance of the roll sheet 1 is completed, the cutter unit 300 that had been standing by at the stand-by position P1 moves in the X direction by driving of the cutter motor 103, so that cutting in the X direction is performed. By completing the movement of the cutter carriage 200 up to the reversing position P2, the cutting is completed, so that a printed subject and a cut piece are produced from the roll sheet 1. The printed subject and the cut piece are discharged to the outside of the apparatus by their own weight.

Figure 12:
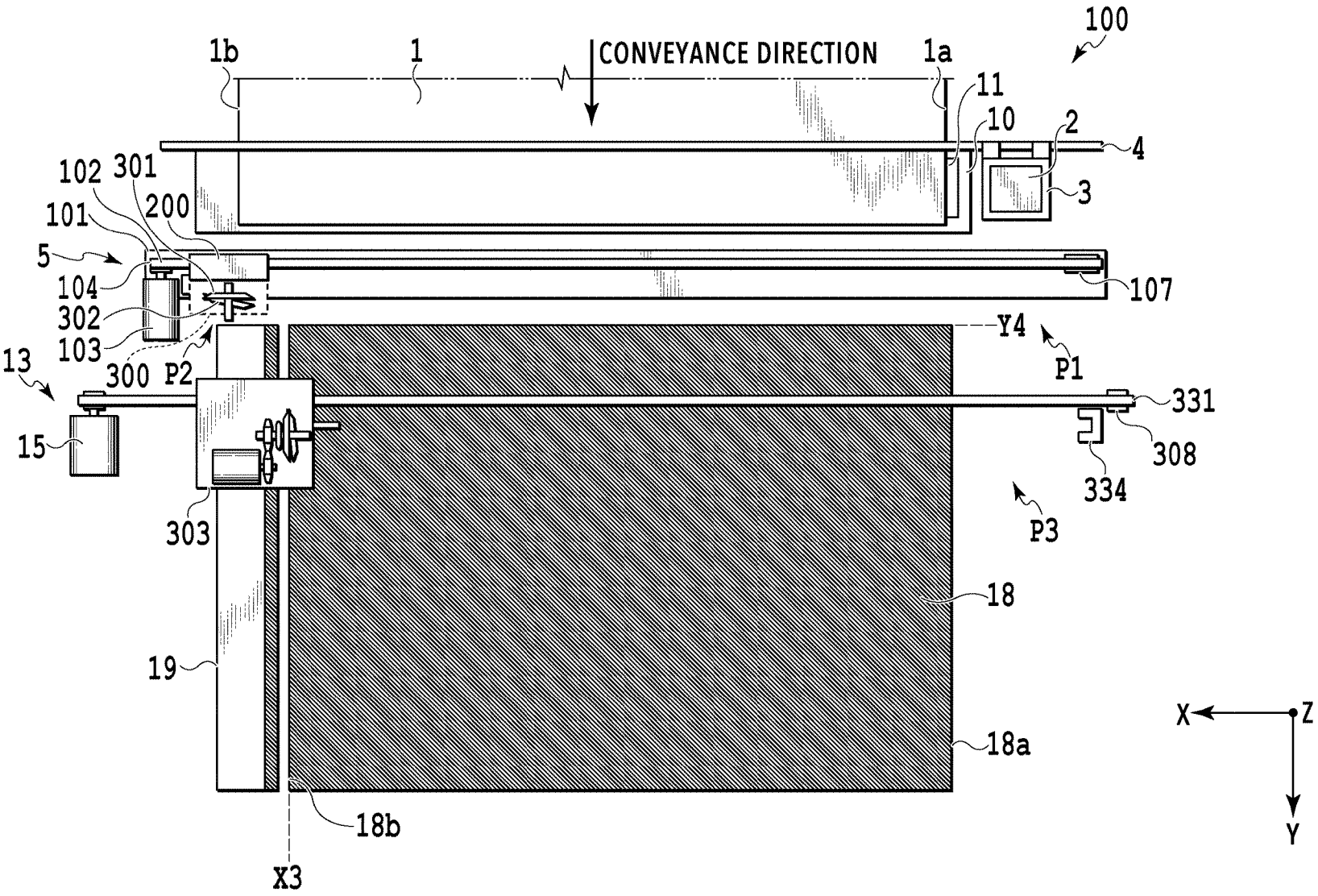
FIG. 12 is a diagram illustrating how an image is printed and a roll sheet is cut.

FIG. 12 is a diagram illustrating a state after cutting is performed at the position Y4 to be cut by the cutter 5. By the cutting with the cutter 5, the printed subject 18 and the cut piece 19 are separated from the roll sheet 1 that is loaded in the printing apparatus 100. The right end 18*a* of the printed subject 18 corresponds to the first end 1*a* of the roll sheet 1 before being separated. The left end 18*b* of the printed subject 18 corresponds to the position to be cut at the cutting position X3 of the roll sheet 1 before being separated.

After the printing of S708 ends or in a case where the cutting by the slitter 13 in S710 has been performed up to a position beyond the position Y4 to be cut by a predetermined length, the cutting by the cutter 5 may be performed after the roll sheet 1 is further conveyed by a predetermined length.

Figure 13:
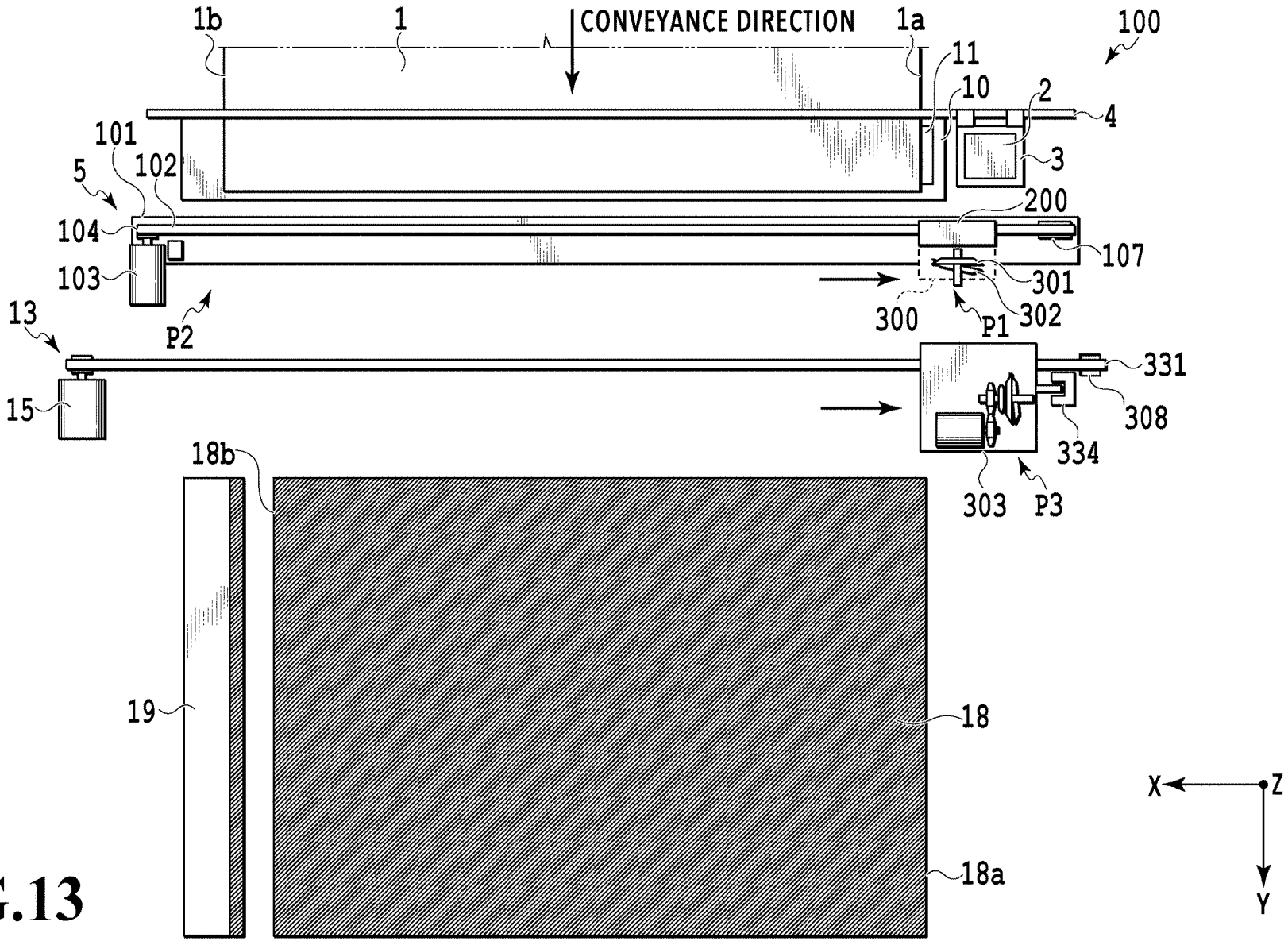
FIG. 13 is a diagram illustrating how an image is printed and a roll sheet is cut.

In S713, the control unit 400 determines whether the slitter unit 303 is positioned at the stand-by position P3. If the slitter unit 303 is not positioned at the stand-by position P3, the processing proceeds to S714, so that the slitter unit 303 is moved to the stand-by position P3 for the next cutting and returns to the stand-by state. If the slitter unit 303 has already been positioned at the stand-by position P3, S714 is skipped. FIG. 13 is a diagram illustrating how the printed subject 18 is discharged to the outside of the printing apparatus 100. Furthermore, how the slitter 13 moves to the stand-by position P3 is illustrated.

Next, an explanation is given of the process of S715, which is performed in a case where an instruction for performing borderless printing is not included in S702. In S715, the control unit 400 determines whether to move the slitter unit 303. For example, if the roll sheet 1 is to be cut in accordance with the size of the image included in the print data, the processing proceeds to S716, and, otherwise, the processing proceeds to S707. S716 is a process equivalent to S706. That is, the slitter unit 303 is moved to a predetermined position to start cutting operation.

As explained above, according to the present embodiment, it is possible to implement borderless printing regardless of the size of the loaded roll sheet 1. Furthermore, it is possible to implement borderless printing regardless of the size of the roll sheet 1 by use of one slitter unit 303. Moreover, compared to a case in which borderless printing is implemented by use of two slitter units, the amount of cut pieces of the roll sheet 1 to be discarded can be reduced. As illustrated in FIG. 13, the printed subject 18 produced in the above-described manner is printed up to the sheet end portions of the left and right ends, or the right end 18*a* and the left end 18*b* of the printed subject 18, and thereby borderless printing is implemented. In particular, in the present embodiment, the first end 1*a* of the roll sheet 1 is the reference for conveying the roll sheet 1, and borderless printing at the right end 18*a*, which is on the home side of the printed subject 18, is implemented by use of an ink processing port only. On the other hand, borderless printing on the left end 18*b* side, which is on the away side of the printed subject 18, is implemented by use of the ink processing ports 11*a* and 11*b* or cutting by the slitter unit 303 in accordance with the width of the roll sheet 1 and print data. According to such a configuration, it is possible to prevent multiple cut pieces from being produced, compared to a configuration in which the left and right end portions of the area corresponding to a printed subject of the roll sheet 1 is cut by use of multiple slitter units. Furthermore, it is possible to cut the roll sheet 1 at a given width. Moreover, by using ink processing ports 11*a* and 11*b* together, it is also possible to implement borderless printing without cutting by the slitter 13.

Although the example in which the cutting position X3 of the slitter unit 303 is determined based on the print data is explained in the present embodiment, it is also possible to determine the cutting position X3 by measuring the range in which an image is printed on the roll sheet 1 by use of an optical sensor, or the like, mounted on the carriage 3, for example.

Furthermore, although the ink receiving portion that receives ink is provided in the platen 10 in the present embodiment, there may be an ink receiving portion configured with a member other than the platen 10 to receive and process ink. For example, a member such as an ink absorber or a member provided with an opening for suctioning ink may be disposed instead of an ink processing port.

Second Embodiment

In the first embodiment, the mode in which the printing apparatus 100 includes one slitter unit 303 is explained. In the present embodiment, the mode in which the printing apparatus 100 includes two slitter units 303 is explained. That is, the example in which two slitter units 303 capable of cutting the left and right end portions of the roll sheet 1 are included is explained.

Figure 14:
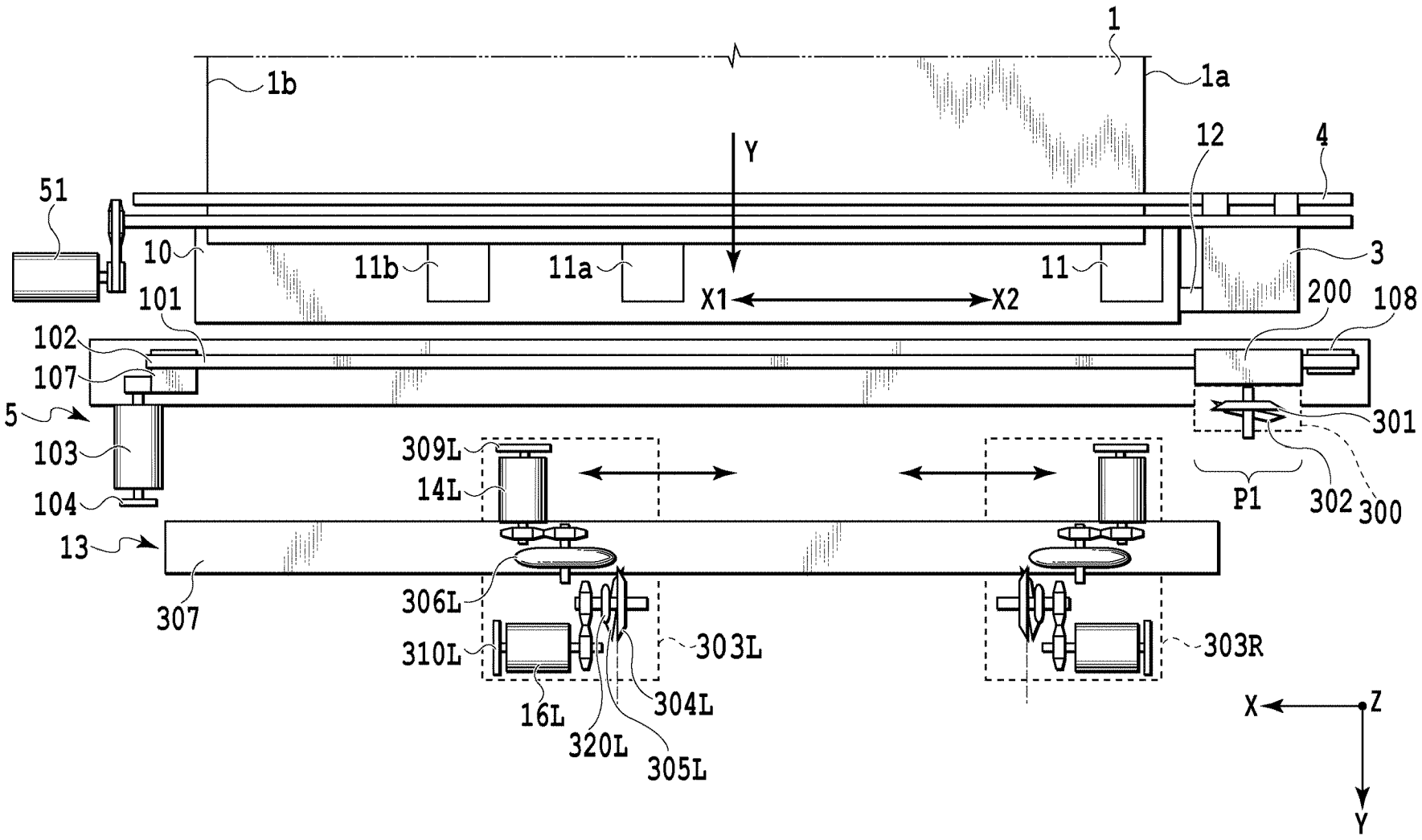
FIG. 14 is a diagram illustrating a configuration in which two slitters are mounted.

With reference to FIG. 14, an explanation is given of the configuration in which two slitter units 303 are mounted. That is, an explanation is given of the example in which the slitter units 303L and 303R are mounted. The slitter units 303L and 303R have the same configuration with the components that are left-right reversals in the X1 and X2 directions. In FIG. 14, for the sake of simplification, reference signs are mainly assigned to the components of the slitter unit 303L.

Figure 15:
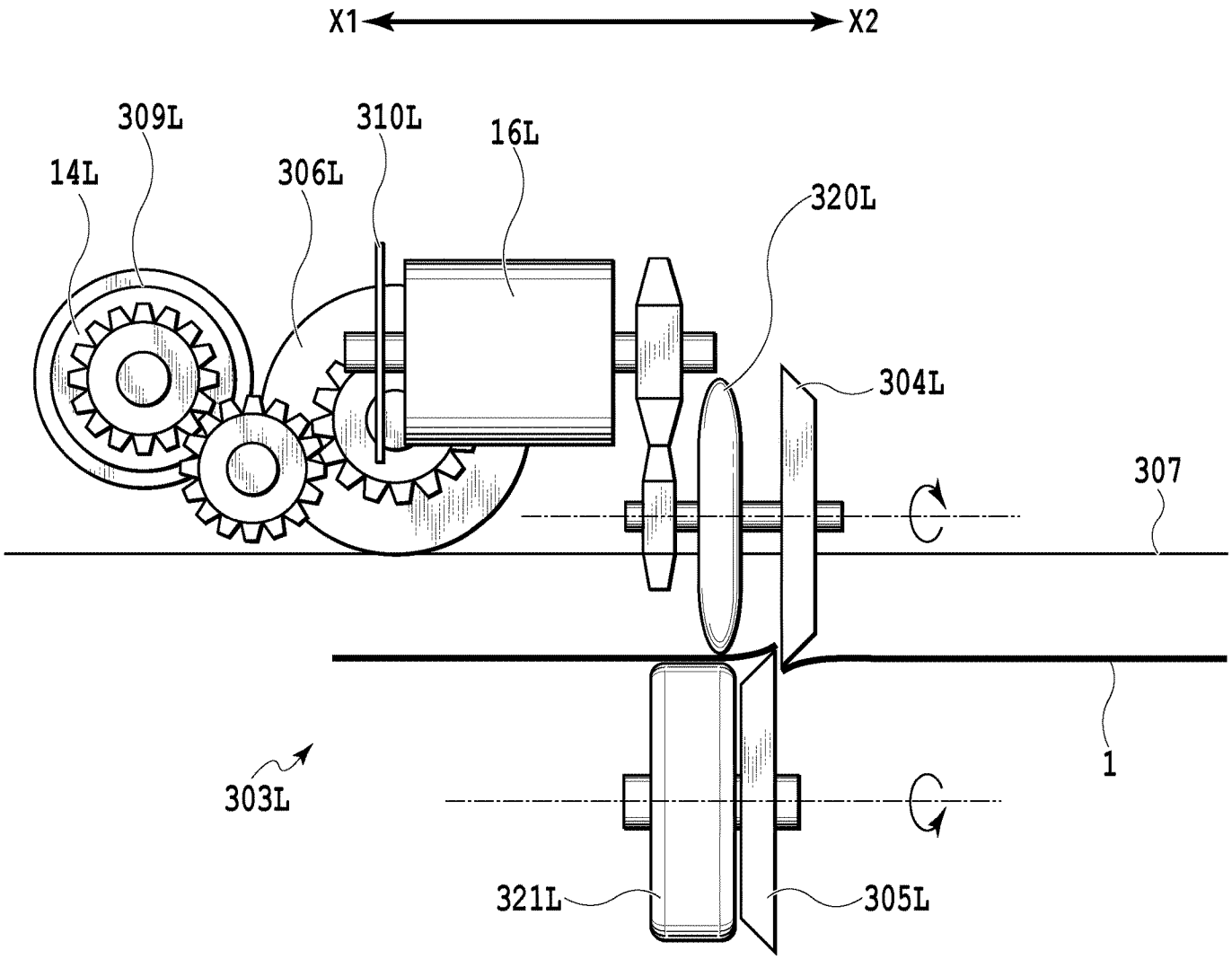
FIG. 15 is a diagram illustrating a slitter.

FIG. 15 is a diagram for explaining the slitter unit 303L. The slitter unit 303L includes the slitter moving motor 14L and is configured such that driving force is transmitted to the slitter moving roller 306L via a gear. The slitter moving roller 306L abuts on the slitter guide rail 307, and the slitter unit 303L is configured to be movable in the X1 and X2 directions by friction between the front surface of the slitter moving roller 306L and the slitter guide rail 307. In other words, the slitter upper movable blade 304L, the slitter lower movable blade 305L, the slitter upper conveyance roller 320L, and the slitter lower conveyance roller 321L are integrally movable along the slitter guide rail 307.

As described above, even in a case where two slitter units 303 are mounted, the same operation as in the first embodiment is performed. However, in the present embodiment, the same processing as in the first embodiment is performed only with one of the two slitter units 303R and 303L. Specifically, in a case where an instruction for performing borderless printing is included, the operation of S705 is performed by use of the slitter unit 303L only. The slitter unit 303L is the slitter unit positioned on the away side, which is the opposite side of the home side where the ink processing port 11 is disposed. The slitter unit 303R is the slitter unit positioned on the home side where the ink processing port 11 is disposed. Here, in the slitter unit 303R, the slitter upper conveyance roller 320 and the slitter lower conveyance roller 321 are disposed on the home side where the ink processing port 11 is disposed. For this reason, if the slitter unit 303R is used instead of the slitter unit 303L, the area where an image is printed is pressed by the slitter upper conveyance roller 320 and the slitter lower conveyance roller 321, and therefore the image quality may be deteriorated due to a wrinkle of the sheet. Therefore, the cutting as explained in the above-described first embodiment is performed by use of one of the two mounted slitter units, that is, by use of the slitter unit 303L, which is positioned on the away side.

Although the slitter moving roller 306L is driven with friction in the present embodiment, the slitter moving roller 306L may have a rack and pinion configuration with a slitter moving roller serving as a pinion and a slitter guide rail serving as a rack.

Other Embodiments

In the above-described embodiments, the explanations have been given with the example of a printing apparatus in which the carriage 3 scans in the X direction while holding the print head 2, so as to perform printing operation. However, there may be a mode in which a print head that is provided with ejection openings corresponding to the size of the printing medium in the width direction, which may be termed as a line-type print head, is used.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-066213, filed Mar. 29, 2019, which is hereby incorporated by reference herein in its entirety.

What is claimed is:

1. A printing apparatus comprising:

a print head configured to eject ink based on print data;

a first conveyance unit configured to convey a printing medium in a conveyance direction;

a receiving portion configured to receive ink ejected beyond a first end of the printing medium in an intersecting direction that intersects the conveyance direction;

a slitter unit including a second conveyance unit for conveying the printing medium being conveyed by the first conveyance unit, the slitter unit being configured to cut the printing medium, while the printing medium is being conveyed by the second conveyance unit in the conveyance direction, at a predetermined position; and a control unit configured to perform control to convey the printing medium in the conveyance direction by the first conveyance unit in a case where cutting of the printing medium is performed by the slitter unit and to convey the printing medium in an opposite direction of the conveyance direction by the first conveyance unit after the cutting of the printing medium by the slitter unit, wherein the print head ejects ink at the first end side of the printing medium in the intersecting direction from the first end through the receiving portion and ejects ink at a second end side of the printing medium in the intersecting direction beyond the predetermined position toward the second end side, and the slitter unit cuts the printing medium being printed at the predetermined position.

2. The printing apparatus according to claim 1, wherein the predetermined position is determined according to the print data.

3. The printing apparatus according to claim 2, wherein the predetermined position corresponds to a position of an end portion of the printing performed on the second end side according to the print data.

4. The printing apparatus according to claim 1, wherein the printing is performed in a case where an instruction for borderless printing is included in the print data.

5. The printing apparatus according to claim 4 further comprising a second receiving portion disposed at a position different from the receiving portion in the intersecting direction and configured to receive ink, wherein whether or not to perform cutting by the slitter unit is switched according to a length of the printing medium in the intersecting direction, the printing medium being loaded in the printing apparatus.

6. The printing apparatus according to claim 5, wherein the cutting by the slitter unit is performed in a case where the length of the printing medium in the intersecting direction does not correspond to a length between the receiving portion and the second receiving portion.

7. The printing apparatus according to claim 5, wherein the cutting by the slitter unit is not performed in a case where the length of the printing medium in the intersecting direction corresponds to a length between the receiving portion and the second receiving portion.

8. The printing apparatus according to claim 5, wherein, in a case where the cutting by the slitter unit is not performed, ink is ejected from the print head to the second receiving portion.

9. The printing apparatus according to claim 5, wherein the second receiving portion is disposed at a position corresponding to a standard size.

10. The printing apparatus according to claim 4 further comprising a second receiving portion disposed at a position different from the receiving portion in the intersecting direction and configured to receive ink, wherein whether or not to perform cutting by the slitter unit is switched based on a length of the printing medium in the intersecting direction and the print data, the printing medium being loaded in the printing apparatus.

11. The printing apparatus according to claim 10, wherein the cutting by the slitter unit is performed in a case where the length of the printing medium in the intersecting direction corresponds to a length between the receiving portion and the second receiving portion as well as where the print data indicates presence of an area in which printing is not performed on the second end side.

12. The printing apparatus according to claim 1 further comprising a cutter configured to cut the printing medium in the intersecting direction on which the cutting by the slitter unit and the printing by the print head having been completed.

13. The printing apparatus according to claim 12, wherein the cutter is disposed on a downstream relative to the print head as well as an upstream relative to the slitter unit in the conveyance direction.

14. The printing apparatus according to claim 1 further comprising a moving unit provided with the slitter unit and configured to move in the intersecting direction.

15. The printing apparatus according to claim 1, wherein the slitter unit has an upper movable blade and a lower movable blade, and the second conveyance unit has an upper conveyance roller and a lower conveyance roller.

16. A printing method of a printing apparatus including (a) a print head configured to eject ink based on print data, (b) a first conveyance unit configured to convey a printing medium in a conveyance direction, (c) a receiving portion configured to receive ink ejected beyond a first end of the printing medium in an intersecting direction that intersects the conveyance direction, (d) a slitter unit including a second conveyance unit for conveying the printing medium being conveyed by the first conveyance unit, the slitter unit being configured to cut the printing medium, while the printing medium is being conveyed by the second conveyance unit in the conveyance direction, at a predetermined position, and (e) a control unit configured to perform control to convey the printing medium in the conveyance direction by the first conveyance unit in a case where cutting of the printing medium is performed by the slitter unit and to convey the printing medium in an opposite direction of the conveyance direction by the first conveyance unit after the cutting of the printing medium by the slitter unit, wherein the print head ejects ink at the first end side of the printing medium in the intersecting direction from the first end through the receiving portion and ejects ink at a second end side of the printing medium in the intersecting direction beyond the predetermined position toward the second end side, and the slitter unit cuts the printing medium being printed at the predetermined position.

17. A printing apparatus comprising:

a print head configured to eject ink based on print data;

a conveyance unit configured to convey a printing medium in a conveyance direction;

a first receiving portion configured to receive ink ejected beyond a first end of the printing medium in an intersecting direction that intersects the conveyance direction;

a second receiving portion disposed at a position different from the first receiving portion in the intersecting direction and configured to receive ink; and a slitter unit configured to cut the printing medium in the conveyance direction at a predetermined position, wherein whether or not to perform cutting by the slitter unit is switched according to a length of the printing medium in the intersecting direction, the printing medium being loaded in the printing apparatus, wherein in case of performing the cutting by the slitter unit, printing on one side of the printing medium in the intersecting direction is performed from the first end through the first receiving portion and printing on the other side of the printing medium in the intersecting direction is performed beyond the predetermined position toward a second end side, which is on an opposite side of the first end, and wherein the printing is performed in a case where an instruction for borderless printing is included in the print data.

18. The printing apparatus according to claim 17, wherein the cutting by the slitter unit is performed in a case where the length of the printing medium in the intersecting direction does not correspond to a length between the first receiving portion and the second receiving portion.

19. The printing apparatus according to claim 17, wherein the cutting by the slitter unit is not performed in a case where the length of the printing medium in the intersecting direction corresponds to a length between the first receiving portion and the second receiving portion.

20. The printing apparatus according to claim 17, wherein the predetermined position is determined according to the print data.

21. The printing apparatus according to claim 17, wherein, in a case where the cutting by the slitter unit is not performed, ink is ejected from the print head to the second receiving portion.

22. The printing apparatus according to claim 17, wherein the second receiving portion is disposed at a position corresponding to a standard size.

23. The printing apparatus according to claim 17, further comprising a cutter configured to cut the printing medium in the intersecting direction on which the cutting by the slitter unit and the printing by the print head having been completed.

24. The printing apparatus according to claim 23, wherein the cutter is disposed downstream relative to the print head and upstream relative to the slitter unit in the conveyance direction.

25. The printing apparatus according to claim 17, wherein the slitter unit includes an upper movable blade and a lower movable blade, and wherein the second conveyance unit includes an upper conveyance roller and a lower conveyance roller.

* * * * *